US009260924B2

(12) United States Patent
Collins et al.

(10) Patent No.: US 9,260,924 B2
(45) Date of Patent: Feb. 16, 2016

(54) FLEXIBLE JOINT CONNECTION

(71) Applicant: GE Oil & Gas ESP, Inc., Oklahoma City, OK (US)

(72) Inventors: Charles Collins, Oklahoma City, OK (US); Aaron Noakes, Norman, OK (US)

(73) Assignee: GE Oil & Gas ESP, Inc.

( * ) Notice: Subject to any disclaimer, the term of this patent is extended or adjusted under 35 U.S.C. 154(b) by 0 days.

(21) Appl. No.: 13/727,300

(22) Filed: Dec. 26, 2012

(65) Prior Publication Data

US 2014/0179448 A1 Jun. 26, 2014

(51) Int. Cl.

| | |
|---|---|
| ***E21B 17/02*** | (2006.01) |
| ***E21B 43/12*** | (2006.01) |
| ***F04C 13/00*** | (2006.01) |
| ***F04C 15/00*** | (2006.01) |
| *F04C 2/107* | (2006.01) |

(52) U.S. Cl.

CPC ..... *E21B 17/02* (2013.01); *E21B 43/128* (2013.01); *F04C 13/008* (2013.01); *F04C 15/0061* (2013.01); *F04C 2/1071* (2013.01)

(58) Field of Classification Search

CPC ..... E21B 43/128

USPC ..... 464/19, 137, 138, 173–176; 175/325.6; 166/242.6, 66.4, 105; 417/410.1

See application file for complete search history.

(56) References Cited

U.S. PATENT DOCUMENTS

| | | | | | |
|---|---|---|---|---|---|
| 1,608,709 | A | * | 11/1926 | Van Auken Mills | 166/66.4 X |
| 1,905,158 | A | * | 4/1933 | Craig et al. | 175/325.6 |
| 1,976,131 | A | * | 10/1934 | Kittredge | 464/137 |
| 2,870,617 | A | * | 1/1959 | Peters | 464/19 |
| 3,255,839 | A | * | 6/1966 | Goldman | 464/175 X |
| 3,423,959 | A | * | 1/1969 | Tate, Sr. et al. | 464/173 |
| 3,703,817 | A | * | 11/1972 | Orwin | |
| 3,785,752 | A | * | 1/1974 | Crespo | 464/173 X |
| 3,802,803 | A | | 4/1974 | Bogdanov et al. | |
| 4,062,412 | A | * | 12/1977 | McIlvanie | 464/19 X |
| 4,157,022 | A | * | 6/1979 | Crase | 464/19 X |
| 4,940,911 | A | * | 7/1990 | Wilson | |
| 5,129,452 | A | | 7/1992 | Wilson | |
| 5,209,294 | A | * | 5/1993 | Weber | 166/105 |
| 5,795,135 | A | * | 8/1998 | Nyilas et al. | |
| 5,860,864 | A | | 1/1999 | Vukovic | |
| 6,868,912 | B2 | | 3/2005 | Proctor | |
| 8,347,953 | B1 | | 1/2013 | Elizondo, Jr. et al. | |
| 2014/0169988 | A1 | | 6/2014 | Pesek et al. | |

OTHER PUBLICATIONS

Written Opinion of the International Searching Authority for PCT/US2013/075423 mailed Nov. 27, 2014.

* cited by examiner

*Primary Examiner* — Gregory Binda

(74) *Attorney, Agent, or Firm* — Crowe & Dunlevy

(57) ABSTRACT

A downhole submersible pumping system includes an adapter for use in connecting a first component to a second component within the downhole pumping system. The adapter preferably includes an upstream section configured for connection to the first component and a downstream section configured for connection to the second component. The adapter further includes an articulating joint that permits the angular movement of the first component with respect to the second component.

4 Claims, 10 Drawing Sheets

FLEXIBLE JOINT CONNECTION

FIELD OF THE INVENTION

This invention relates generally to the field of electrical submersible pumping systems, and more particularly, but not by way of limitation, to adapters for connecting components within the pumping system.

BACKGROUND

Submersible pumping systems are often deployed into wells to recover petroleum fluids from subterranean reservoirs. Typically, a submersible pumping system includes a number of components, including an electric motor coupled to one or more high performance pump assemblies. Production tubing is connected to the pump assemblies to deliver the petroleum fluids from the subterranean reservoir to a storage facility on the surface.

The motor is typically an oil-filled, high capacity electric motor that can vary in length from a few feet to nearly one hundred feet, and may be rated up to hundreds of horsepower. Prior art motors often include a fixed stator assembly that surrounds a rotor assembly. The rotor assembly rotates within the stator assembly in response to the sequential application of electric current through different portions of the stator assembly. The motor transfers power to the pump assembly through a common shaft keyed to the rotor. For certain applications, intermediate gearboxes can be used to increase the torque provided by the motor to the pump assembly.

Pump assemblies often employ axially and centrifugally oriented multi-stage turbomachines. Most downhole turbomachines include one or more impeller and diffuser combinations, commonly referred to as "stages." In many designs, each impeller rotates within adjacent stationary diffusers. During use, the rotating impeller imparts kinetic energy to the fluid. A portion of the kinetic energy is converted to pressure as the fluid passes through the downstream diffuser. The impellers are typically keyed to the shaft and rotate in unison.

Often, it is desirable to deploy the pumping system in an offset, deviated, directional, horizontal or other non-vertical well. In these applications, the length and rigidity of the pumping system must be considered as the system is deployed and retracted through curved or angled portions of the well. As the incidence of non-vertical wellbores increases, there is need for a pumping system that can navigate these non-vertical deployments. It is to this and other deficiencies in the prior art that the present invention is directed.

SUMMARY OF THE INVENTION

In preferred embodiments, the present invention includes an electrical submersible pumping system configured for deployment in a non-vertical wellbore. The electrical submersible pumping system includes an adapter for use in connecting a first component within a downhole pumping system to a second component within the downhole pumping system. The adapter preferably includes an upstream section configured for connection to the first component and a downstream section configured for connection to the second component. The adapter further includes an articulating joint that permits the angular movement of the first component with respect to the second component. In additional aspects, the adapter includes a series of shafts for transferring torque between the first and second components. In yet another additional aspect, the adapter includes a fluid path for providing fluid communication between the first and second components.

DETAILED DESCRIPTION OF THE PREFERRED EMBODIMENTS

Figure 1:
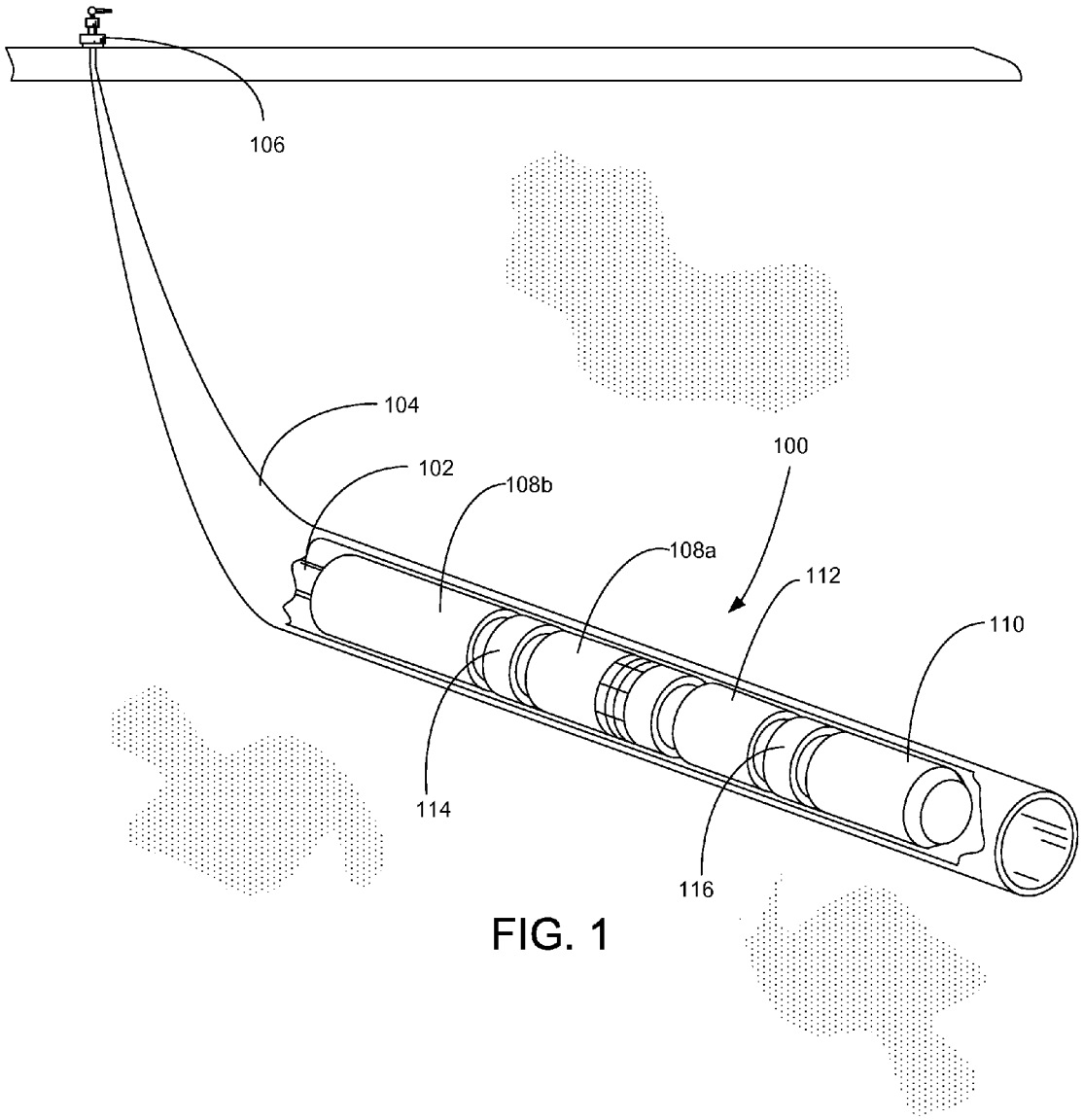
FIG. 1 is a back view of a downhole pumping system constructed in accordance with a presently preferred embodiment.

In accordance with a preferred embodiment of the present invention, FIG. 1 shows a front perspective view of a downhole pumping system 100 attached to production tubing 102. The downhole pumping system 100 and production tubing 102 are disposed in a wellbore 104, which is drilled for the production of a fluid such as water or petroleum. The downhole pumping system 100 is shown in a non-vertical well. This type of well is often referred to as a "directional," "deviated" or "horizontal" well. Although the downhole pumping system 100 is depicted in a horizontal well, it will be appreciated that the downhole pumping system 100 can also be used in vertical wells.

As used herein, the term "petroleum" refers broadly to all mineral hydrocarbons, such as crude oil, gas and combinations of oil and gas. The production tubing 102 connects the pumping system 100 to a wellhead 106 located on the surface. Although the pumping system 100 is primarily designed to pump petroleum products, it will be understood that the present invention can also be used to move other fluids. It will also be understood that, although each of the components of the pumping system 100 are primarily disclosed in a submersible application, some or all of these components can also be used in surface pumping operations.

The pumping system 100 preferably includes a combination of one or more pump assemblies 108, one or more motor assemblies 110 and one or more seal sections 112. In the preferred embodiment depicted in FIG. 1, the pumping system 100 includes a single motor assembly 110, a single seal section 112 and two separated pump assemblies 108*a*, 108*b*. The two pump assemblies 108*a*, 108*b* are connected by a flexible pump adapter 114. The pumping system 100 further includes a flexible motor adapter 116 that connects the motor assembly 110 to the seal section 112. As used in this disclosure, the terms "upstream" and "downstream" provide relative positional information for components within the pumping system 100 with reference to the flow of pumped fluids through the pumping system 100. In this way, the pump assembly 108*a* is the "upstream" pump assembly and the pump assembly 108*b* is the "downstream" pump assembly. Although a single motor assembly 110 is depicted in FIG. 1, it will be understood that the pumping system 100 may include multiple motor assemblies 110 that are concatenated or trained together. It will further be appreciated that the pumping system 100 may also include multiple seal sections 112.

The motor assembly 110 is an electrical motor that receives its power from a surface-based supply. The motor assembly 110 converts the electrical energy into mechanical energy, which is transmitted to the pump assemblies 108*a*, 108*b* by one or more shafts. The pump assemblies 108*a*, 108*b* then transfer a portion of this mechanical energy to fluids within the wellbore, causing the wellbore fluids to move through the production tubing 102 to the surface. In a particularly preferred embodiment, the pump assemblies 108*a*, 108*b* are turbomachines that use one or more impellers and diffusers to convert mechanical energy into pressure head. In an alternative embodiment, the pump assemblies 108*a*, 108*b* include a progressive cavity (PC) or positive displacement pump that moves wellbore fluids with one or more screws or pistons. The seal section 112 shields the motor assembly 110 from mechanical thrust produced by the pump assembly 108. The seal section 112 is also preferably configured to prevent the introduction of contaminants from the wellbore 104 into the motor assembly 110.

The flexible pump adapter 114 is configured to connect two adjacent components within the pumping system 100 with a mechanism that permits a degree of angular offset between the components. In preferred embodiments, the flexible pump adapter 114 transfers torque from an upstream component to a downstream component, and includes an internal path for transferring pumped fluids between the two components. Accordingly, the flexible pump adapter 114 is preferably utilized for connecting two components within the pumping system 100 that together provide a path for pumped fluids. As depicted in FIG. 1, the flexible pump adapter 114 provides a fluid flow path from the discharge of the upstream pump assembly 108*a* to the intake of the downstream pump assembly 108*b*. Notably, the flexible pump adapter 114 can be used to provide an articulating connection between any two components within the pumping system 100, including, for example, seal section-to-seal section connections and seal section-to-intake adapter connections.

The flexible motor adapter 116 is configured to connect two adjacent components within the pumping system 100 with a mechanism that permits a degree of angular offset between the components. In preferred embodiments, the flexible motor adapter 116 transfers torque from an upstream component to a downstream component, where the connection does not require an internal path for transferring pumped fluids. Accordingly, the flexible motor adapter 116 is designed for connecting two components within the pumping system 100 that do not cooperatively provide a path for pumped fluids. As depicted in FIG. 1, the flexible motor adapter 116 connects the motor assembly 110 and the seal section 112. Notably, the flexible motor adapter 116 can be used to provide an articulating connection between any two components within the pumping system 100, including, for example, to provide an articulating joint for pump assemblies placed below the motor(s) in what is referred to as a "sumped" configuration.

Figure 2:
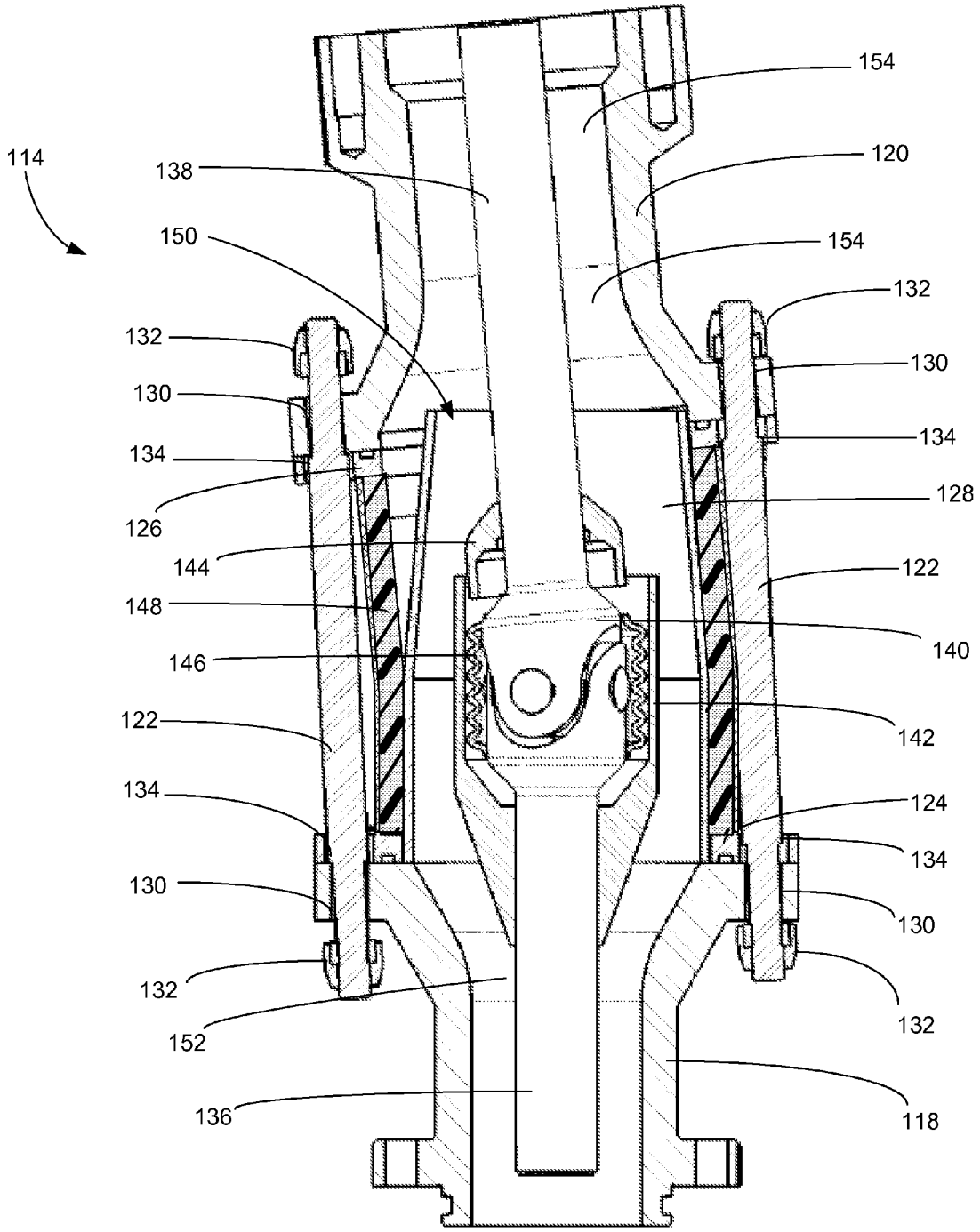
FIG. 2 is a partial cross-sectional view of a first preferred embodiment of the flexible pump adapter of the pumping system of FIG. 1.
Figure 12:
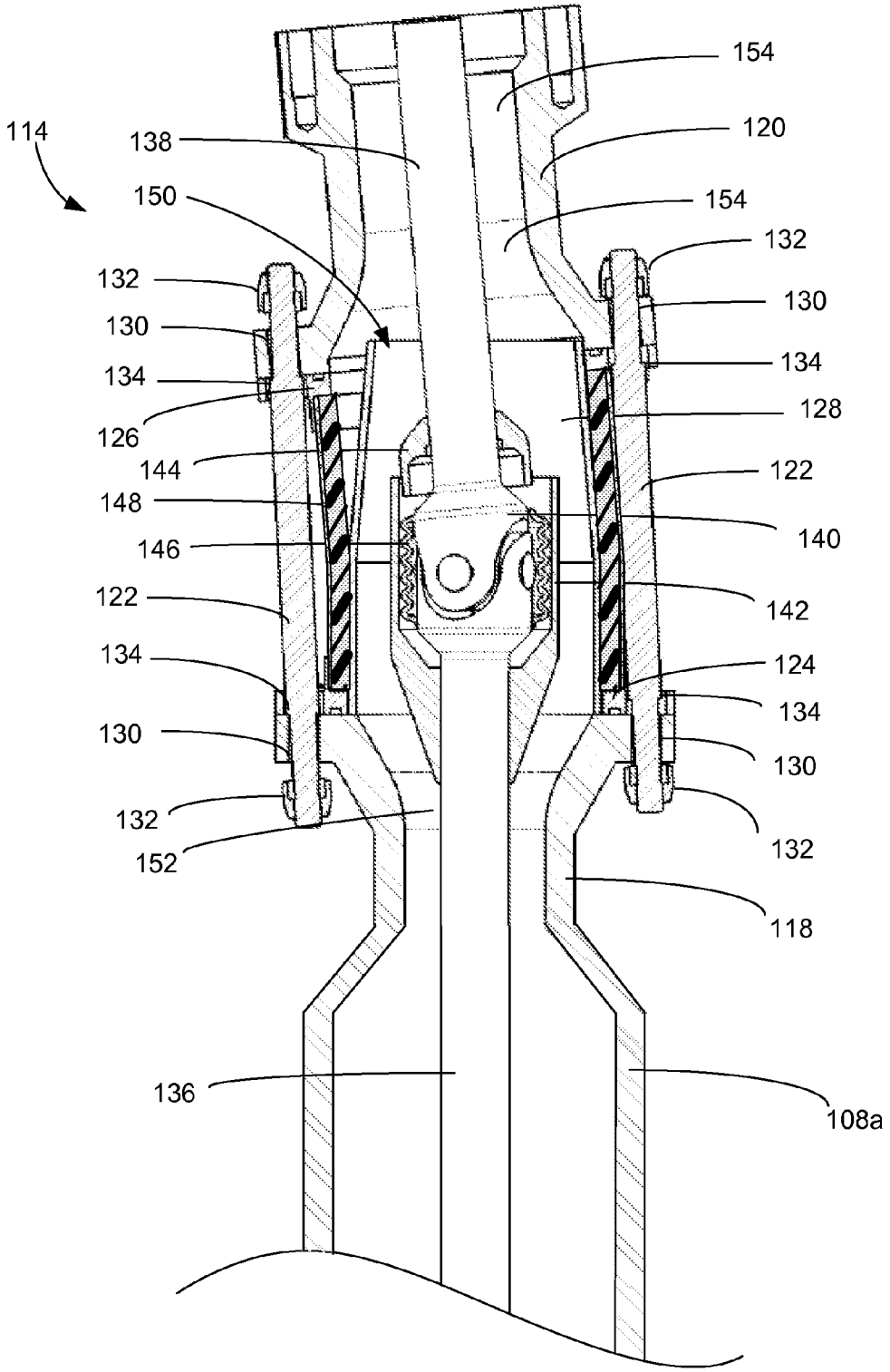
FIG. 12 is a partial cross-sectional view of a first preferred embodiment of the flexible pump adapter of the pumping system of FIG. 1 in which the flexible pump adapter is integral with the upstream pump assembly.

Referring now to FIG. 2, shown therein is a cross-section view of a first preferred embodiment of the flexible pump adapter 114. Generally, the flexible pump adapter 114 provides an articulating connection between two adjacent components with the pumping system 100. The flexible pump adapter 114 includes an upstream section 118 for connecting to an upstream component and a downstream section 120 for connecting to a downstream component. In the preferred embodiment depicted in FIG. 1, the upstream section is connected to the upstream pump assembly 108*a* and the downstream section 120 is connected to the downstream pump assembly 108*b*. Unless otherwise noted, each component of the flexible pump adapter 114 is manufactured from a suitable metal or metal alloy, such as, for example, steel, stainless steel, or Inconel. Although the upstream section 118 and downstream section 120 are depicted as separate elements that can be attached to upstream and downstream components within the pumping system 100, it will be understood that the upstream section 118 and downstream section 120 can also be formed as an integral part of the respective upstream or downstream component, as illustrated in FIG. 12. For example, the upstream section 118 could be part of the pump assembly 108*a*, while the downstream section 120 could be part of the pump assembly 108*b*. For these embodiments, the flexible pump adapter 114 incorporates elements from the adjacent components within the pumping system 100, including a common upstream shaft 136 extending from the pump assembly 108*a* into the upstream section 118.

Turning back to FIG. 2, the flexible pump adapter 114 further includes a plurality of axial bolts 122, an upstream retainer 124, a downstream retainer 126 and a joint guard 128. The axial bolts 122 extend through, and connect, the upstream section 118 and the downstream section 120. Each of the upstream section 118 and downstream section 120 include axial bolt bores 130 that receive a corresponding one of the plurality of axial bolts 122. The diameter of the axial bolt bores 130 is larger than the outer diameter of the corresponding axial bolts 122. The axial bolts 122 are therefore provided a small degree of lateral movement within the axial bolt bores 130. Each axial bolt 122 includes a pair of axial bolt caps 132 that are preferably configured for threaded engagement with the opposing distal ends of each axial bolt 122. The axial bolt caps 132 are larger than the axial bolt bores 130. Each axial bolt 122 further includes a pair of axial bolt inner limiters 134 located at a predetermined distance from the ends of the axial bolt 122. In the embodiment depicted in FIG. 2, the axial bolt inner limiters 134 are presented as larger diameter shoulders on the axial bolts 122, but it will be appreciated that the axial bolt inner limiters 134 can also be nuts, flanges or pins.

During angular articulation, portions of the upstream section 118 and downstream section 120 separate, while opposite portions approximate. As depicted in FIG. 2, the right-hand side of the upstream section 118 and downstream section 120 have separated, while the left-hand side of the upstream section 118 and downstream section 120 have been pushed together. The axial bolts 122 on the right-hand side are placed in tension as the axial bolt caps 132 press against the separating portions of the upstream section 118 and downstream section 120. In contrast, the axial bolts 122 and axial bolt bores 130 positioned on the opposite side of the flexible pump adapter 114 allow the upstream section 118 and downstream section 120 to be drawn together until the upstream section 118 and downstream section 120 contact the axial bolt inner limiters 134. Once the upstream and downstream sections 118, 120 contact the axial bolt inner limiters 134, the corresponding axial bolts 122 are placed into compression. In this way, the axial bolts 122, axial bolt bores 130, axial bolt caps 132 and axial bolt inner limiters 134 form an "articulating joint" that permits a degree of angular articulation between the upstream section 118 and downstream section 120, while limiting the rotational movement and axial dislocation between the upstream and downstream sections 118, 120. Importantly, the flexible pump adapter 114 is designed to transfer the weight of upstream components within the pumping system 100 to downstream components when the pumping system 100 is placed in a non-horizontal deployment. The axial bolt caps 132 and axial bolt inner limiters 134 provide a facilitated method for controlling the extent of articulation within the flexible pump adapter 114. By adjusting or fixing the relative distances between the axial bolt caps 132 and axial bolt inner limiters 134, the degree of articulation can be consistently controlled.

Continuing with FIG. 2, the flexible pump adapter 114 further includes an adapter drivetrain that includes an upstream shaft 136, a downstream shaft 138 and a shaft coupling 140. The upstream shaft 136 is configured for connection to the upstream component within the pumping system 100 (e.g., the upstream pump assembly 108*a*) and the downstream shaft 138 is configured for connection to the downstream component within the pumping system 100 (e.g., the downstream pump assembly 108*b*). The upstream shaft 136 and the downstream shaft 138 are connected by the shaft coupling 140. In a presently preferred embodiment, the shaft coupling 140 is a conventional u-joint mechanism that includes a cross member that connects to offset yokes on the upstream and downstream shafts 136, 138.

Figure 10:
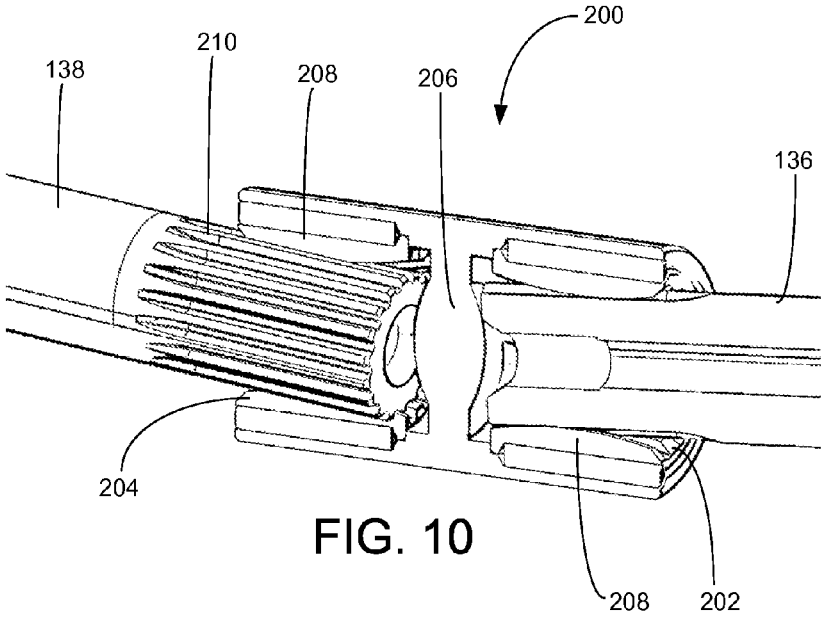
FIG. 10 is a perspective view of a flex receiver constructed in accordance with a first preferred embodiment.
Figure 11:
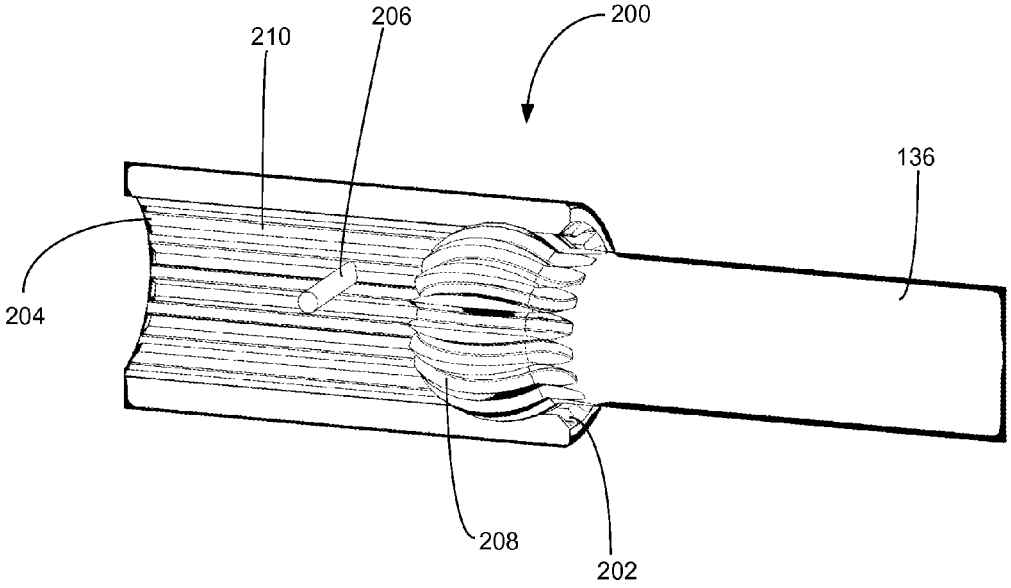
FIG. 11 is a perspective view of a flex receiver constructed in accordance with a second preferred embodiment.

Alternatively, the shaft coupling 140 can be configured as a ball-and-socket arrangement that includes a rounded spline connection with a receiving splined socket. Turning to FIGS. 10 and 11, shown therein are alternative embodiments of the shaft coupling 140. In the embodiment depicted in FIG. 10, the shaft coupling 140 includes a flex receiver 200 that includes an upstream receptacle 202, a downstream receiver 204 and a divider 206. Each of the upstream and downstream receptacles 202, 204 has a series of convex curved splines 208 that mate with straight splines 210 on the ends of the upstream and downstream shafts 136, 138. The convex curved splines 208 may be provided as inserts within the flex receiver 200. The placement of the straight splines 210 within the curved splines 208 allows the upstream and downstream shafts 136, 138 to rock while maintaining contact with the flex receiver 200. The divider 206 limits the axial displacement of the upstream and downstream shafts 136, 138.

In the alternative embodiment depicted in FIG. 11, the flex receiver 200 includes straight splines 210 within the upstream receiver 202 and downstream receiver 204. The ends of the upstream and downstream shafts 136, 138 (only the upstream shaft 136 is depicted in FIG. 11) are provided with convex curved splines 208. In this way, the upstream and/or downstream shafts 136, 138 are allowed to articulate within the flex receiver 200. In a particularly preferred embodiment, the convex curved splines 208 of the upstream and downstream shafts 136, 138 are presented on a separate head attachment that fits over a standard splined end of the upstream and downstream shafts 136, 138. The use of a separate convex splined shaft adapter reduces manufacturing and material costs and permits the use of the flex receiver 200 with standard shafts. In the embodiment depicted in FIG. 11, the divider 206 includes a single post rather than a larger partition between the upstream and downstream receivers 202, 204. In yet other embodiments, the shaft coupling 140 is configured as a constant velocity (CV) joint or Birfield-type joint.

The flexible pump adapter 114 further includes a coupling housing 142, a coupling cap 144 and coupling bellows 146. The coupling housing 142 is preferably secured to the upstream shaft 136 and the coupling cap 144 is secured to the downstream shaft 138. The coupling housing 142 and coupling cap 144 cooperate to shield the shaft coupling 140 from debris and fluids moving through the flexible pump adapter 114. The coupling bellows 146 isolate the shaft coupling 140 from fluid and debris present within the coupling housing 142. In a presently preferred embodiment, the coupling bellows 146 are manufactured from a folded and flexible elastomer or polymer. To further protect the shaft coupling 140, a second bellows (not shown) may be used to prevent migration of fluid and debris between the coupling cap 144 and the coupling housing 142. Alternatively, the coupling bellows 146 are manufactured from a metal or a combination of metal and polymer.

The joint guard 128 surrounds the shaft coupling 140, the coupling housing 142 and the coupling cap 144. The joint guard 128 is preferably configured as a substantially cylindrical tube, with a tapered downstream end. The upstream end of the joint guard 128 is held in position adjacent the upstream section 118 by the upstream retainer 124. Alternatively, the upstream end of the joint guard 128 can be connected to the upstream section 118 with a welded or threaded connection, or presented as a unitary construction. The conical shape of the downstream side of the joint guard 128 allows the upstream and downstream sections 118, 120 to articulate.

To isolate the interior of the flexible pump adapter 114 from the surrounding wellbore 104, the flexible pump adapter 114 includes a flexible outer housing 148. The outer housing 148 is preferably constructed from a flexible, impermeable material that is sufficiently durable to withstand the internal pressures of the pumped fluid and the inhospitable external environment. Suitable materials include creased metal, woven metal mesh and elastomers. In a particularly preferred embodiment, the outer housing 148 includes a woven metal mesh exterior with a polymer liner. Suitable polymers include polytetrafluoroethylene (PTFE), perfluoroalkoxy (PFA), polyetheretherketone (PEEK), tetrafluoroethylene/propylene (TFE/P) (Aflas), fluorine terpolymer (FKM) (Viton), highly saturated nitrile (HSN) or hydrogenated nitrile butadiene rubber (HNBR), and metallized polymers. The outer housing 148, joint guard 128, coupling housing 142 and coupling cap 144 cooperate to protect the shaft coupling 140 while permitting the upstream and downstream sections 118, 120 to articulate.

It will be noted that the flexible pump adapter 114 also includes an internal fluid passage 150 for pumped fluids exchanged between the upstream and downstream components connected to the flexible pump adapter 114. To this end, the upstream section 118 includes an upstream section throat 152 and the downstream section 120 includes a downstream section throat 154. The upstream section throat 152 includes an annular space around the upstream shaft 136. The downstream section throat 154 includes an annular space around the downstream shaft 138. The fluid passage 150 is created by the annular spaces within the upstream and downstream section throats 152, 154 and the annular space between the joint guard 128 and the coupling housing 142 and coupling cap 144.

Accordingly, although it is not required that the flexible pump adapter 114 be connected between adjacent pump assemblies 108, the flexible pump adapter 114 is particularly well-suited for providing a point of articulation between two components within the pumping system 100 that are configured for providing a passage for the movement of pumped fluids. It will be noted, however, that in certain applications, it may be desirable to remove the upstream and downstream shafts 136, 138, the shaft coupling 140, the coupling housing 142, the coupling cap 144 and the coupling bellows 146. In these alternate embodiments, the flexible pump adapter 114 is not configured to transfer torque from an upstream shaft to a downstream shaft, but only provides a point of articulation between two components within the pumping system 100 that are configured for providing a passage for the movement of pumped fluids. For example, it may be desirable to use the flexible pump adapter 114 without the adapter drivetrain to connect the discharge side of the pump assembly 108*b* to the production tubing 102.

Figure 3:
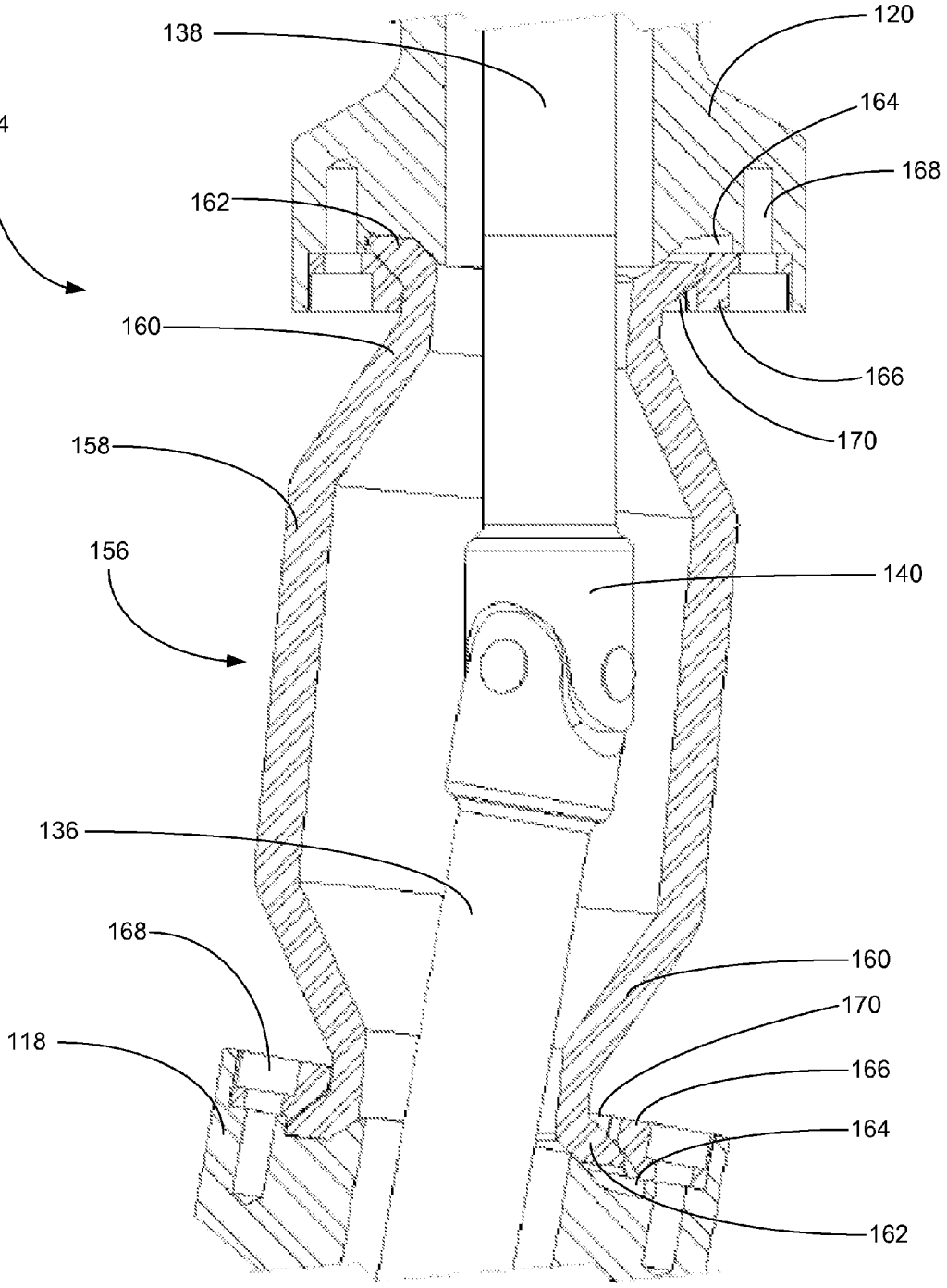
FIG. 3 is a partial cross-sectional view of a second preferred embodiment of the flexible pump adapter of the pumping system of FIG. 1.

Turning to FIG. 3, shown therein is a cross-sectional depiction of a second preferred embodiment of the flexible pump adapter 114. Unless otherwise indicated, the second preferred embodiment of the flexible pump adapter 114 includes the same components identified during the description of the first preferred embodiment shown in FIG. 2. Unlike the first preferred embodiment, the second preferred embodiment does not include axial bolts 122 that extend through axial bolt bores 130 in the upstream and downstream sections 118, 120. Instead, the second preferred embodiment of the flexible pump adapter 114 makes use of an articulating joint formed by a rigid joint chamber 156 that is pivotally connected to the upstream and downstream sections 118, 120.

The joint chamber 156 is preferably cylindrical and includes a large central chamber 158 that tapers on both ends to flange ends 160. The central chamber accommodates the lateral displacement of the shaft coupling 140 during the articulation of the flexible pump adapter 114. The joint chamber 156 includes flared ends 162 at the open end of each flange end 160.

The upstream and downstream sections 118, 120 both include a receiving recess 164 that is configured to receive the flared end 162 of the joint chamber 156. Each of the upstream and downstream sections 118, 120 further includes a locking collar 166 that captures the flared ends 162 of the joint chamber 156 within the respective upstream and downstream section 118, 120. The locking collars 166 are secured to the upper and lower flanges 118, 120 with collar bolts 168. In a particularly preferred embodiment, the locking collar 166 is configured as a split collar that includes two or more separate pieces that can be placed around the outside of the flange ends 160 of the joint chamber 156. The locking collars 166 include a central opening 170 that extends the receiving recess 164 of the upstream and downstream sections 118, 120. Although the locking collars 166 are shown bolted to the upstream and downstream sections 118, 120, the locking collars 166 may alternatively be configured for a threaded engagement with the upstream and downstream sections 118, 120.

The receiving recesses 164 and locking collars 166 are configured to permit the slight movement of the flared ends 162 relative to the upstream and downstream sections 118, 120. Thus, the flared ends 162 are somewhat loosely captured within the receiving recesses 164, but prohibited from being removed from the receiving recesses 164 of the locking collar 166. This permits the angular articulation of the upstream and downstream sections 118, 120 around the joint chamber 158. In a particularly preferred variation of this embodiment, the receiving recesses 164 are machined with close tolerances to the width of the flared ends 162 such that the extent of articulation is limited as the flared ends 160 bind within the receiving recesses 164. In addition to limiting the extent of articulation, the close tolerances presented between the flared ends 162 and the receiving recess 164 creates a substantially impermeable seal between the upstream and downstream sections 118, 120 and the joint chamber 156.

Figure 4:
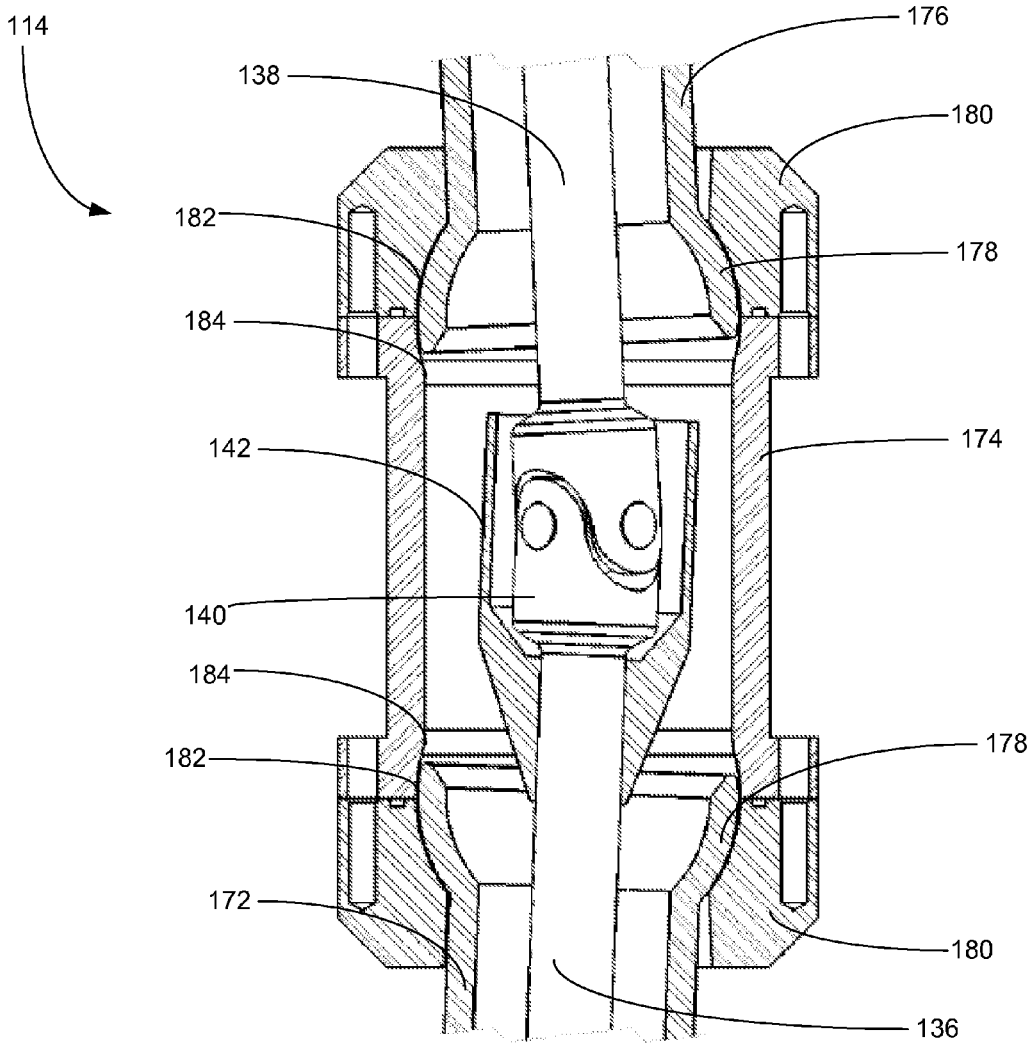
FIG. 4 is a partial cross-sectional view of a third preferred embodiment of the flexible pump adapter of the pumping system of FIG. 1.

Turning to FIG. 4, shown therein is a cross-sectional depiction of a third preferred embodiment of the flexible pump adapter 114. Unless otherwise indicated, the third preferred embodiment of the flexible pump adapter 114 includes the same components identified during the description of the first preferred embodiment shown in FIG. 2. Unlike the first preferred embodiment, the third preferred embodiment does not include axial bolts 122 that extend through axial bolt bores 130 in the upstream and downstream sections 118, 120. Instead, the third preferred embodiment of the flexible pump adapter 114 makes use of an articulating joint formed by pivoting flanges connected to a rigid joint chamber that together provide a degree of articulation.

In the third preferred embodiment, the flexible pump adapter 114 includes an upstream pivot section 172, a fixed coupling chamber 174 and a downstream pivot section 176. Each of the upstream and downstream pivot sections 172, 176 includes a rounded base 178. The flexible pump adapter 114 further includes cap pieces 180 that hold the upstream pivot section 172 and downstream pivot section 176 in place within the fixed coupling chamber 174. The cap pieces 180 are preferably bolted onto the coupling chamber 174. Alternatively, the cap pieces 180 may be configured for a threaded engagement with the upstream and downstream pivot sections 172, 176. Although not depicted in FIG. 4, it may be desirable in certain applications to place a bellows, boot or other articulating sealing mechanism around the outer surfaces of the cap pieces 180 and the respective upstream and downstream pivot sections 172, 176. The outer sealing mechanism further restricts the passage of fluids into, and out of, the fixed coupling chamber 174.

The fixed coupling chamber 174 and the cap pieces 180 each include an interior profile that forms a socket 182 that matingly receives the rounded base of each of the upstream and downstream pivot sections 172, 176. The interior profile of the coupling chamber 174 further includes an interior shoulder 184 that prevents the upstream and downstream pivot sections 172, 176 from being pushed into the coupling chamber 174. In this way, the coupling chamber 174, cap pieces 180 and the rounded bases 178 of the upstream and downstream pivot sections 172, 176 create a ball-and-socket articulating joint that permits angular articulation about the flexible pump adapter 114, but resists separation or compression along the longitudinal axis of the flexible pump adapter 114.

Figure 5:
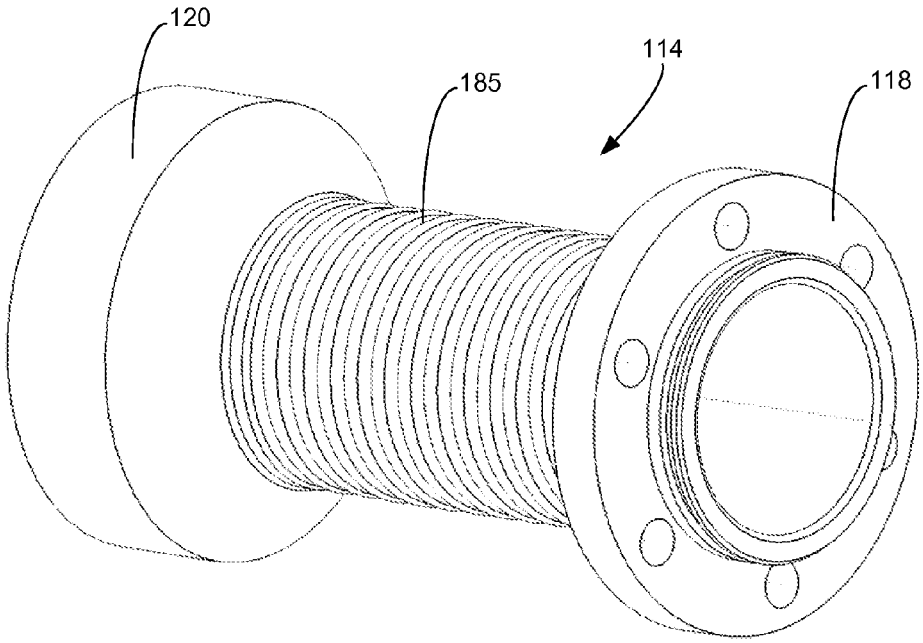
FIG. 5 is a perspective view of a fourth preferred embodiment of the flexible pump adapter of the pumping system of FIG. 1.
Figure 6:
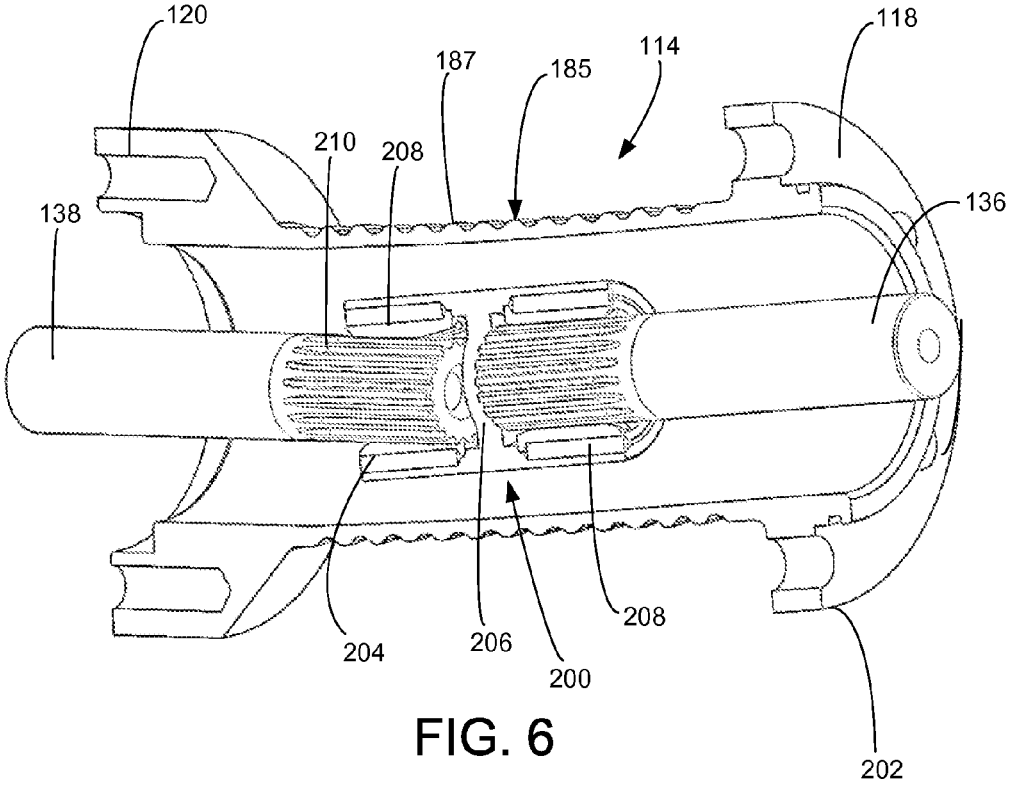
FIG. 6 is a cross-sectional view of the fourth preferred embodiment of FIG. 5.

Turning to FIGS. 5 and 6, shown therein are perspective and cross-sectional views, respectively, of a fourth preferred embodiment of the flexible pump adapter 114. In the fourth preferred embodiment, the flexible pump adapter 114 includes a flexible metal casing 185 extending between the upstream section 118 and the downstream section 120. The flexible metal casing 185 is preferably constructed by creating spiral or parallel grooves around the outer diameter of a metal cylinder. The resulting ribbed exterior 187 of the metal casing 185 permits a degree of bending when exposed to lateral stress, but will not crush under axial (longitudinal) stress. In addition to the ribbed exterior 187, the metal casing 185 may optionally, or alternatively, include a ribbed internal surface (not shown in FIGS. 5 and 6). Although the metal casing 185 is depicted as a unitary part of the upstream section 118 and downstream section 120, it will be appreciated that the metal casing 185 can be manufactured as a separate component that can be attached to the upstream and downstream sections 118, 120. As depicted in FIG. 6, the fourth preferred embodiment of the flexible pump adapter 114 preferably includes the flex receiver 200 between the upstream and downstream shafts 136, 138. It will be noted that fourth preferred embodiment of the flexible pump adapter 114 can employ other shaft couplings 140, and can also be used without shafts.

Figure 7:
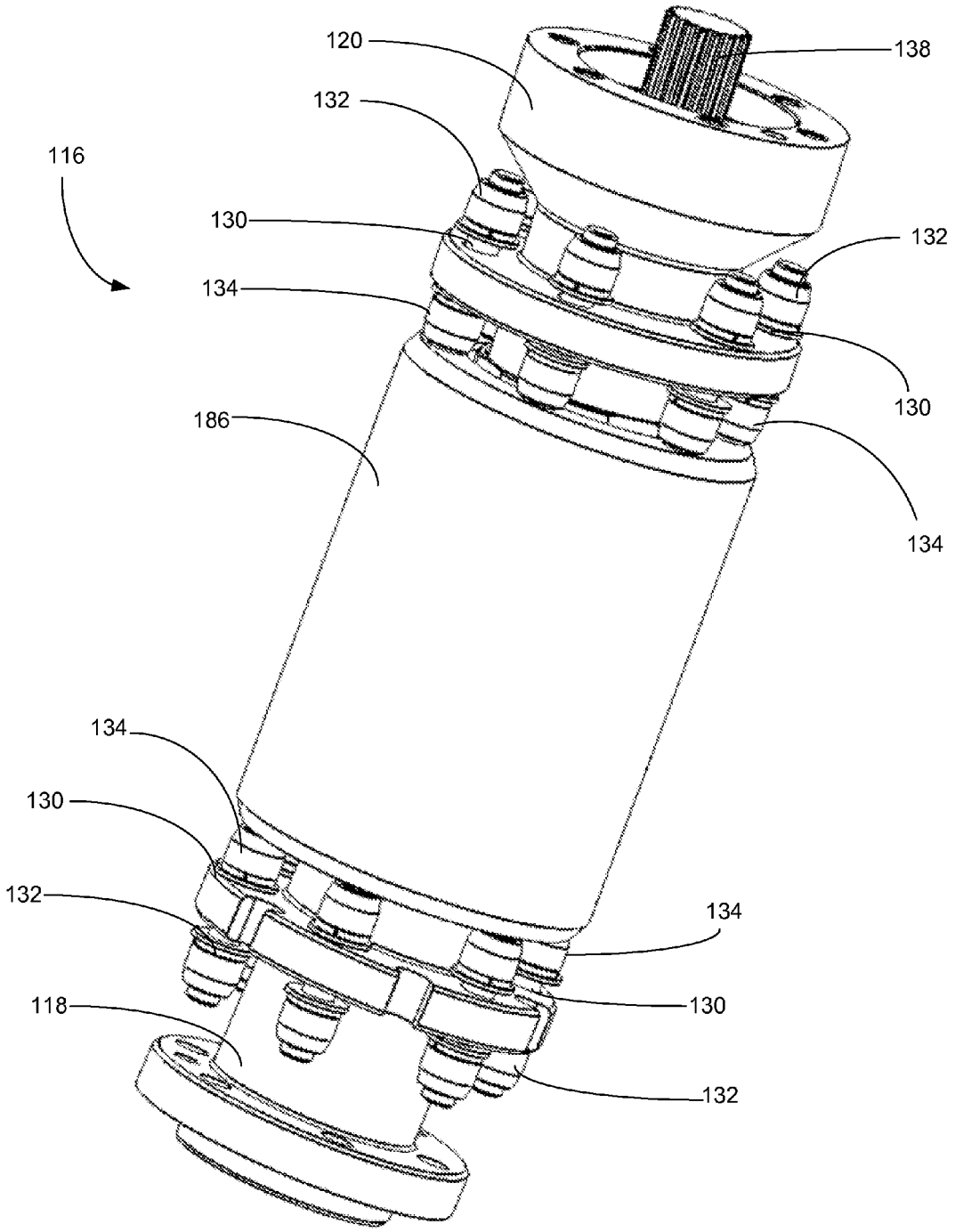
FIG. 7 is a perspective view of a flexible motor adapter constructed in accordance with a first preferred embodiment.
Figure 8:
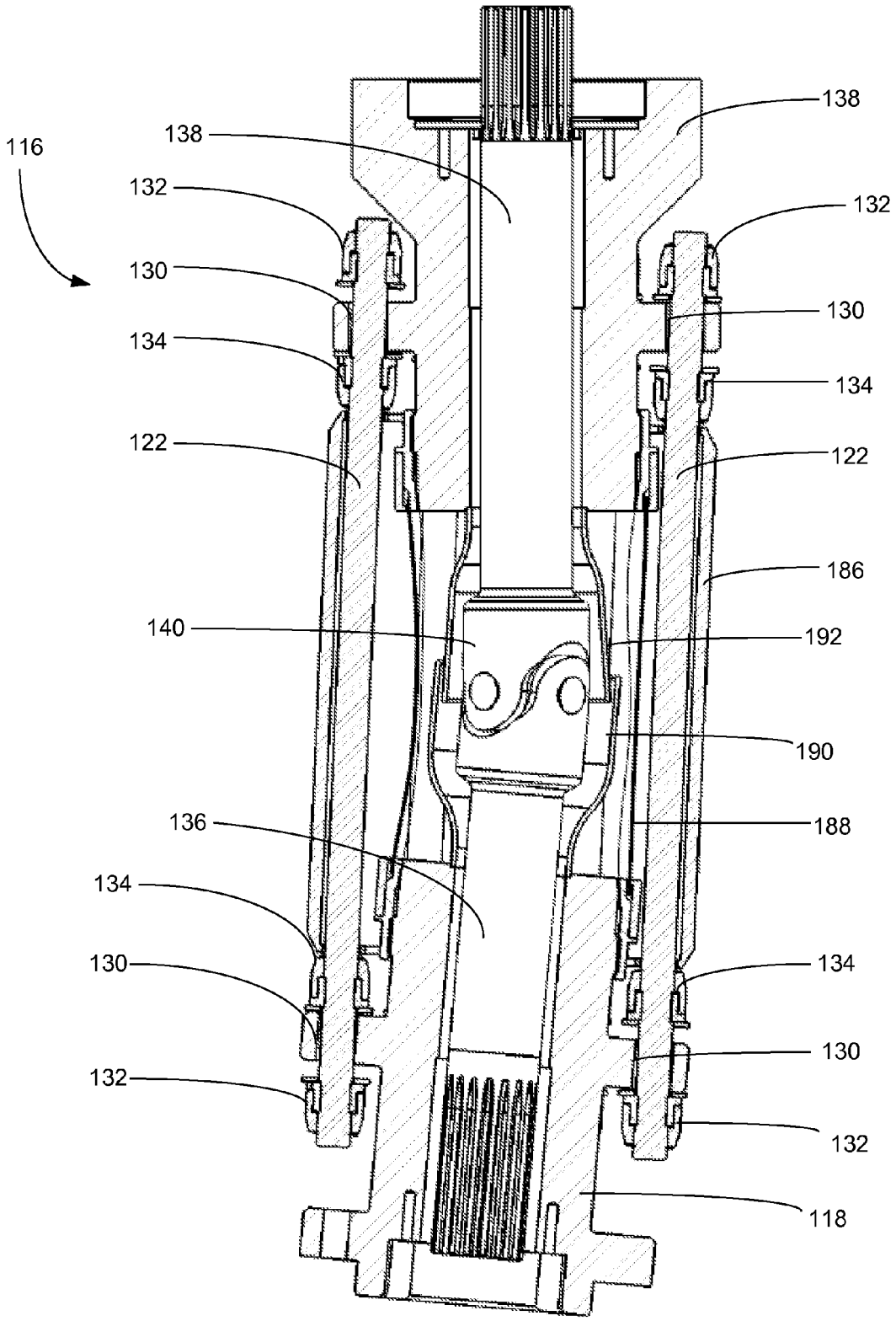
FIG. 8 is a cross-sectional view of the flexible motor adapter of FIG. 7.

Turning now to FIGS. 7 and 8, shown therein are perspective and cross-sectional views, respectively, of the flexible motor adapter 116. Unless otherwise indicated, the flexible motor adapter 116 includes the same components identified during the description of the first preferred embodiment of the flexible pump adapter 114 shown in FIG. 2. Unlike the flexible pump adapter 114, however, the flexible motor adapter 116 does not include the fluid passage 150 and is not configured to permit the passage of pumped fluids between components connected to the flexible motor adapter 116. Instead, the flexible motor adapter 116 is configured to transfer torque with a flexible connection between two components of the pumping system 100. It will be noted that the flexible motor adapter 116 includes passages to permit the passage of motor lubricants or other internal fluids between adjacent components within the pumping system 100. The flexible motor adapter 116 may also include pass-through ports that permit the internal routing of electrical wiring between adjacent components within the pumping system 100.

The flexible motor adapter 116 preferably includes an exterior shield 186 and an interior barrier 188. In a particularly preferred embodiment, the exterior shield 188 rides between the axial bolt inner limiters 134, which are configured as nuts in this embodiment. In this way, the exterior shield 186 is not rigidly affixed to the upstream and downstream sections 118, 120. The exterior shield 186 is preferably constructed from a suitable metal or metal alloy and protects the axial bolts 122 and interior barrier 188 from mechanical impact and abrasion.

The interior barrier 188 extends between the upstream retainer 124 and the downstream retainer 126. The interior barrier 188 is preferably constructed from a flexible, impermeable membrane that prohibits the passage of external fluids into the interior of the flexible motor adapter 116. In particularly preferred embodiment, the interior barrier 188 is manufactured from a polymer, such as, for example, polytetrafluoroethylene (PTFE), perfluoroalkoxy (PFA), polyetheretherketone (PEEK), tetrafluoroethylene/propylene (TFE/P)(Aflas), fluorine terpolymer (FKM) (Viton), highly saturated nitrile (HSN) or hydrogenated nitrile butadiene rubber (HNBR), and metallized polymers.

Figure 9:
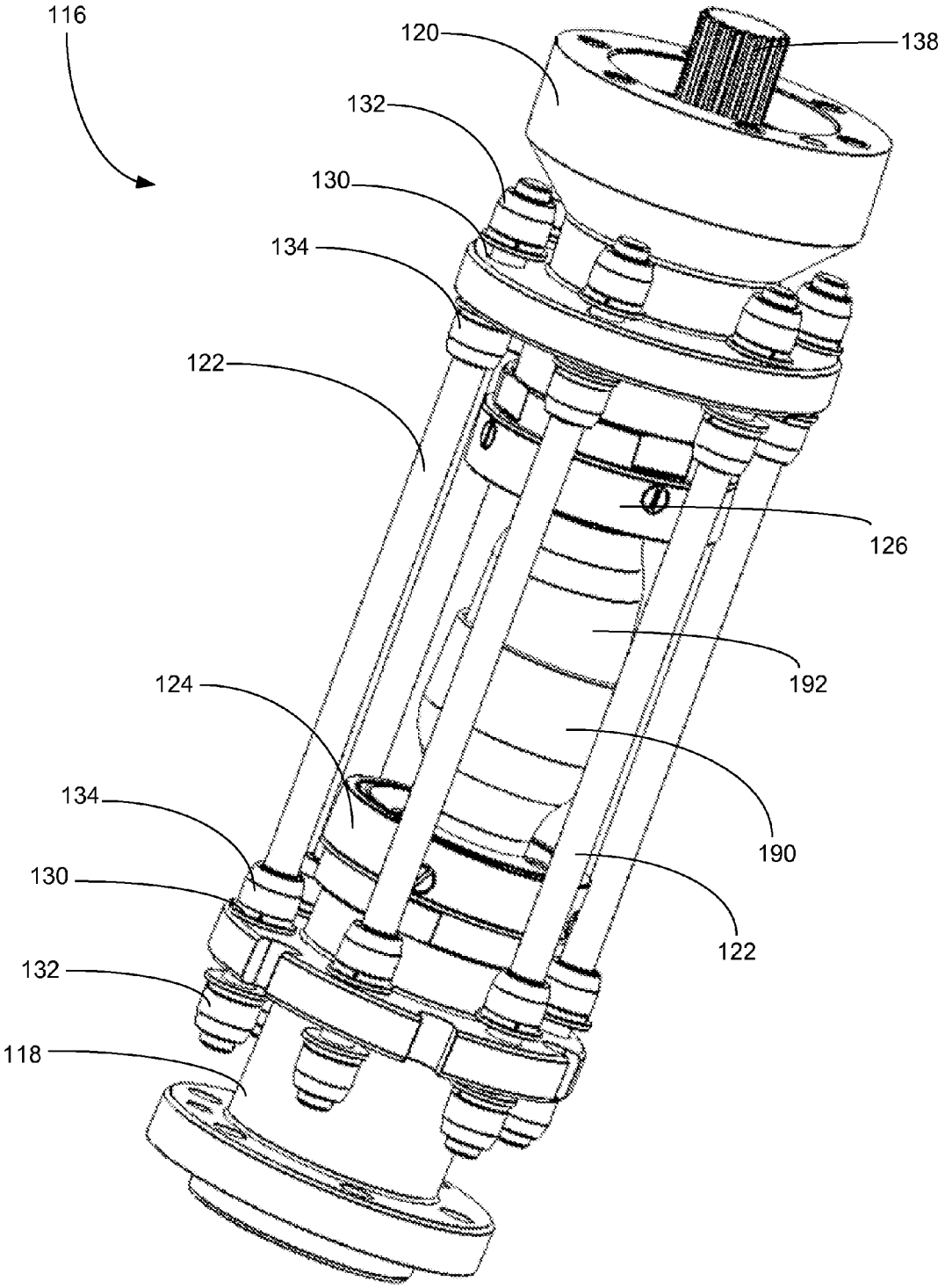
FIG. 9 is a perspective view of the flexible motor adapter of FIG. 7 with the outer shield and inner membrane removed for clarity.

Referring now also to FIG. 9, shown therein is a perspective view of the flexible motor adapter 116 with the exterior shield 186 and the interior barrier 188 removed for clarity. The flexible motor adapter 116 includes an upstream cup 190 and a downstream cup 192 that are each attached, respectively, to the upstream and downstream sections 118, 120. The upstream cup 190 and downstream cup 192 are preferably sized such that the open end of one of the cups fits within the open end of the other cup. In the embodiment depicted in FIGS. 7 and 8, the downstream cup 192 partially extends inside the upstream cup 190. The upstream and downstream cups 190, 192 protect the flexible interior barrier 188 from contact with the rotating shaft coupling 140 and critical internal components.

Accordingly, the flexible motor adapter 116 is well-suited for providing a point of articulation between two components within the pumping system 100 through which a shaft is used to transfer mechanical energy. It will be noted, however, that in certain applications, it may be desirable to remove the upstream and downstream shafts 136, 138, the shaft coupling 140 and the upstream and downstream cups 190, 192. In these alternate embodiments, the flexible motor adapter 116 is not configured to transfer torque from an upstream shaft to a downstream shaft, but only provides a point of articulation between two components within the pumping system 100. For example, it may be desirable to use the flexible motor adapter 116 without the drivetrain to connect the motor assembly 110 to monitoring modules connected upstream of the motor assembly 110. Furthermore, although the flexible motor adapter 116 has been described with an articulating joint that uses axial bolts 122 and axial bolt bores 130, it will be appreciated that the flexible motor adapter 116 can also employ the articulating joints depicted in the second and third embodiments of the flexible pump adapter 114. Specifically, it is contemplated that the flexible motor adapter 116 can make use of the flared-end and recess articulating joint depicted in FIG. 3 and the ball-and-socket articulating joint depicted in FIG. 4. It will also be noted that the presently preferred embodiments contemplate the use of multiple flexible pump adapters 114 and flexible motor adapters 116. As non-limiting examples, two flexible pump adapters 114 or two flexible motor adapters 116 can be connected to provide articulating joints that provide an increased range of motion. In certain embodiments, it may be desirable to include a series of radial support bearings within the flexible motor adapter 116 or flexible pump adapter 114 to support the upstream and downstream shafts 136, 138 if they are rotated while in an offset angular alignment.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A submersible pumping system comprising:
an upstream component;
a downstream component; and
a flexible adapter connected between the upstream component and the downstream component, wherein the flexible adapter comprises:
an upstream section adjacent the upstream component;
a downstream section adjacent the downstream component;
a flexible and impermeable outer housing extending from the upstream section to the downstream section; and
an articulating joint, wherein the articulating joint includes a fluid path that places the upstream component in fluid communication with the downstream component.

2. The submersible pumping system of claim 1, wherein the articulating joint comprises:
a plurality of axial bolt bores extending through the upstream section and the downstream section; and a plurality of axial bolts, wherein each of the plurality of axial bolts extends through a corresponding pair of the axial bolt bores within the upstream section and the downstream section and wherein the axial bolt bores have a diameter that is larger than the outer diameter of the axial bolts.

3. A submersible pumping system comprising:

an upstream component selected from the group consisting of pump assemblies, motor assemblies and seal sections;

a downstream component selected from the group consisting of pump assemblies, motor assemblies and seal sections; and a flexible adapter connected between the upstream component and the downstream component, wherein the flexible adapter comprises:

an upstream section configured for connection to the upstream component;

a downstream section configured for connection to the downstream component;

an articulating joint surrounding the flexible and impermeable outer housing that permits an angular articulation between the upstream section and the downstream section;

an upstream shaft;

a downstream shaft;

a flexible and impermeable outer housing; and a shaft coupling contained within the flexible and impermeable outer housing that permits an angular articulation between the upstream shaft and downstream shaft.

4. The submersible pumping system of claim 3, wherein the shaft coupling is selected from the group consisting of: universal joints; constant velocity joints, and flex receivers.

* * * * *